US006393619B1

(12) United States Patent
Bardes

(10) Patent No.: US 6,393,619 B1
(45) Date of Patent: May 28, 2002

(54) ANKLET FOR ENCIRCLING AN ANKLE OF A CHILD AND ENGAGING A FOOT COVERING SO AS TO PREVENT LOSS OF THE FOOT COVERING

(76) Inventor: Kimberly N. Bardes, 16 Chardonnay Dr., Coram, NY (US) 11727-2432

( * ) Notice: Subject to any disclaimer, the term of this patent is extended or adjusted under 35 U.S.C. 154(b) by 0 days.

(21) Appl. No.: 09/884,545

(22) Filed: Jun. 19, 2001

(51) Int. Cl.[7] ..... A47D 7/06
(52) U.S. Cl. ..... 2/232
(58) Field of Search ..... 2/232, 59, 60, 2/312, 160, 170, DIG. 6, 231, 233, 338, 269

(56) References Cited

U.S. PATENT DOCUMENTS

| | | | | | |
|---|---|---|---|---|---|
| 415,575 | A | * | 11/1889 | Selling | |
| 475,749 | A | * | 5/1892 | Benjamin | |
| 696,842 | A | | 4/1902 | Phelps | |
| 1,023,581 | A | | 4/1912 | Monaghan | |
| 1,256,444 | A | | 2/1918 | Derritt | |
| 1,361,565 | A | | 12/1920 | Christy | |
| 2,480,276 | A | * | 8/1949 | Wilkenfeld | |
| 2,596,112 | A | | 5/1952 | Aines | 2/314 |
| 2,670,474 | A | * | 3/1954 | Schultz | 2/312 |
| 2,710,409 | A | | 6/1955 | Burandt | 2/160 |
| 3,124,286 | A | | 3/1964 | Dompier | 224/28 |
| 3,184,883 | A | | 5/1965 | McCook | 46/32 |
| 3,238,537 | A | * | 3/1966 | Fowler et al. | 2/242 |
| 3,382,505 | A | * | 5/1968 | Walser, Jr. | |
| 3,501,774 | A | | 3/1970 | Norman | 2/321 |
| 4,159,792 | A | | 7/1979 | Siegal | 224/267 |
| 4,489,867 | A | | 12/1984 | Schwemberger | 224/222 |
| 4,525,877 | A | | 7/1985 | Chong | 2/161 |
| 4,825,475 | A | | 5/1989 | Smart | 2/312 |
| 4,843,654 | A | * | 7/1989 | March | 2/227 |
| 4,932,079 | A | | 6/1990 | Bridgewaler | 2/313 |
| 4,941,213 | A | * | 7/1990 | Grilliot et al. | 2/312 |
| D326,917 | S | | 6/1992 | Roberts et al. | D24/194 |
| 5,204,996 | A | | 4/1993 | Ehmka | 2/240 |
| 5,214,798 | A | | 6/1993 | McLaughlin | 2/160 |
| 5,214,805 | A | | 6/1993 | Cochran | 2/232 |
| 5,483,704 | A | | 1/1996 | Filipiak | 2/336 |
| 5,535,448 | A | * | 7/1996 | Williamson et al. | 2/22 |
| 5,539,933 | A | * | 7/1996 | Garber et al. | 2/311 |
| 5,558,440 | A | | 9/1996 | Miller | 383/87 |
| 5,699,555 | A | * | 12/1997 | Schunter | 2/1 |
| 5,704,066 | A | | 1/1998 | Yamamoto | 2/161.6 |
| 5,809,569 | A | | 9/1998 | Bruno et al. | 2/159 |
| 5,950,240 | A | | 9/1999 | Carpenter et al. | 2/160 |
| 6,158,057 | A | * | 12/2000 | Newmann | 2/312 |

* cited by examiner

*Primary Examiner*—John J. Calvert
*Assistant Examiner*—Alissa L. Hoey
(74) *Attorney, Agent, or Firm*—Richard L. Miller

(57) ABSTRACT

An anklet that includes a strap that encircles an ankle of a child, a quick disconnect buckle that is affixed to, and selectively maintains, the strap around the ankle, and a leash that depends from the strap and engages a foot covering worn by the child so as to prevent loss of the foot covering if unintentionally removed. The strap includes an ankle-facing layer that is made of an elastomer with a modulus of elasticity, and an ambient-facing layer that directly overlies the ankle-facing layer and is made of a fabric that has a limited modulus of elasticity so as to prevent the ankle-facing layer from passing the modulus of elasticity thereof and failing. The leash is an endless loop that extends through the foot covering and then extends back through itself, and in so doing, becomes self-fastened to the foot covering.

20 Claims, 1 Drawing Sheet

FIG. 1
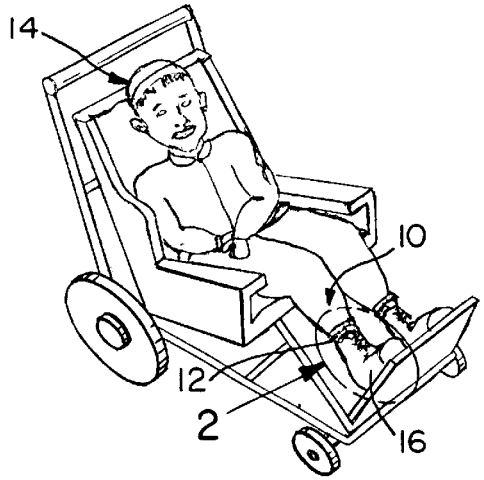
FIG. 2
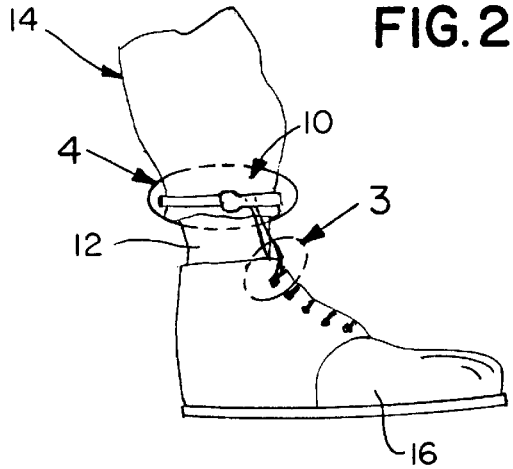
FIG. 4
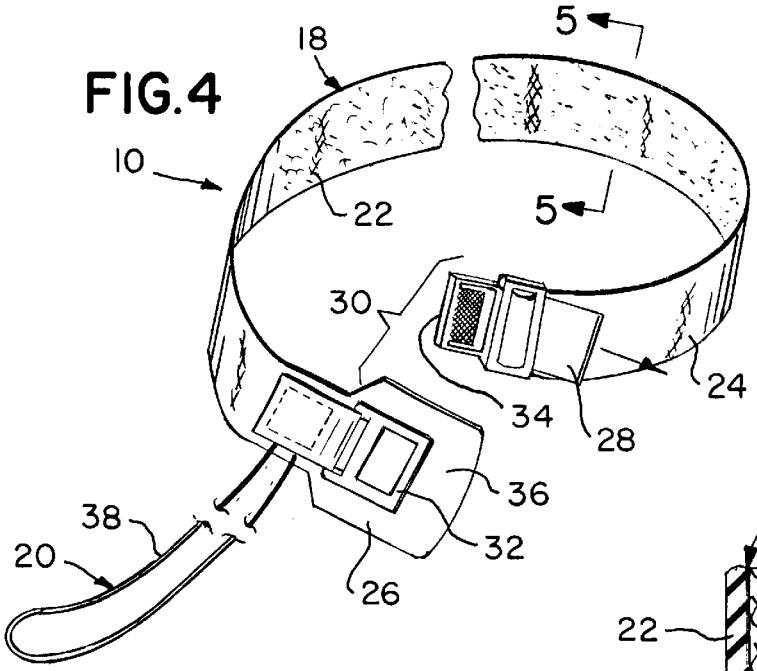
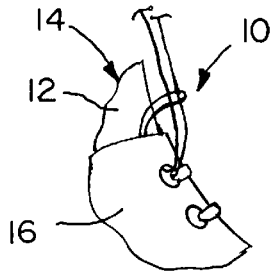
FIG. 3
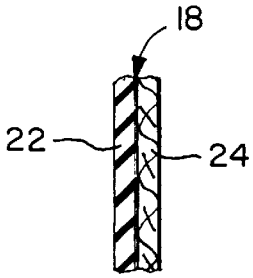
FIG. 5

ANKLET FOR ENCIRCLING AN ANKLE OF A CHILD AND ENGAGING A FOOT COVERING SO AS TO PREVENT LOSS OF THE FOOT COVERING

BACKGROUND OF THE INVENTION

1. Field of the Invention

The present invention relates to an anklet. More particularly, the present invention relates to an anklet for encircling an ankle of a child and engaging a foot covering worn by the child so as to prevent loss of the foot covering if unintentionally removed.

2. Description of the Prior Art

Numerous innovations for garment anchoring devices have been provided in the prior art that will be described. Even though these innovations may be suitable for the specific individual purposes to which they address, however, they differ from the present invention.

A FIRST EXAMPLE, U.S. Pat. No. Des. 326,917 to Roberts et al. teaches the ornamental design for a retaining strap for a pacifier.

A SECOND EXAMPLE, U.S. Pat. No. 696,842 to Phelps teaches a garment-supporter comprising a clasp, a suspending-cord attached thereto and a band to which the cord is connected and which is formed to have a short stretch and elasticity sufficient only to cause the garter to cling to the leg without binding or producing an objectionable tension, and which has an inner surface of rougher or coarser material than the outer surface.

A THIRD EXAMPLE, U.S. Pat. No. 1,023,581 to Monaghan teaches a mitt having a body of a length and width for accommodating the four fingers of a personas hand to hold the said fingers in extended position and one alongside the other, a retaining band extending longitudinally from the rear upper end of the mitt body, and a wrist band on the rear end of the said retaining band and adapted to encircle the wrist of the person using the mitt, the ends of the wrist band being provided with fastening means for holding the wrist band in closed position around the wrist of the user.

A FOURTH EXAMPLE, U.S. Pat. No. 1,256,444 to Derritt teaches a garment supporter comprising a triangular shaped piece of material to be attached to a sock, the said material disposed with two of its corners uppermost, a limb encircling tape secured at a point in its length to the projecting extremity of the triangular shaped piece of material across the entire width thereof, said tape having its extremities projecting beyond the opposite diverging sides of said material, one of said ends having a plurality of longitudinally extending eyelets, and a hook-like element carried by the opposite end of said tape for engagement with any one of said openings for securing the tape about the limb of the user.

A FIFTH EXAMPLE, U.S. Pat. No. 1,361,565 to Christy teaches a mitten retainer comprising a wrist band, a connecting strap secured to the wrist band by passing one end across the outer face of the wrist band and then returning the same across the inner face of the band, a mitten attaching element held against the inner face of the band by the portion of the connector lying across the same, and a fastening device carried by the free end of the connector.

A SIXTH EXAMPLE, U.S. Pat. No. 2,596,112 to Aines teaches a method of blousing trouser bottoms which comprises coupling a strap means to the wearer's shoe at a point slightly below the top thereof, raising the trouser bottom to a point adjacent the top of the shoe with the bottom of the trouser slightly overlapping the top of the shoe and the coupling point, applying the strap means about the trouser bottom to bind it to the wearer's leg at a point just above the shoe top, thereby causing excess trouser material to fold down over the shoe top.

A SEVENTH EXAMPLE, U.S. Pat. No. 2,710,409 to Burandt teaches the a pair of gloves each having a separate fastener adjacent the hem thereof; a leash having one end secured to one glove at the point of the fastener thereon; and separate fasteners on opposite sides of the other end of said leash adapted to detachably engage the fasteners on opposite gloves.

AN EIGHTH EXAMPLE, U.S. Pat. No. 3,124,286 to Dompier teaches a key holder comprising a wrist-encircling bracelet embodying an elongated stone provided at one end with a passage opening through said one end of opening at its opening end through a median portion of one length-wise surface of the stone, said median portion being provided with a recess constituting a bead-receiving seat, an elongated elastic wrist-encircling element having one end permanently attached to a cooperating end of the stone opposite to the first-named end of the stone, the other end of said flexible element being free and passing slidingly through said passage from said one end toward said median portion and through the end of the passage which opens through said median portion, a chain-anchoring bead connected to the terminal of said free end portion and normally but accessibly lodged in said seat, a plurality of beads strung on that portion of the elastic element between the respective end portions of said stone, a key ring, and means connecting said key ring with said anchoring bead.

A NINTH EXAMPLE, U.S. Pat. No. 3,184,883 to McDook teaches a body harness including a flat body encompassing band, sized to fit a child for whom the harness is designed, a toy tether, means mounting said tether on said band in such a position so that the length of the tether when unstressed is less than the extended reach limit of the seated child wearing said harness, said mounting means including a tab of flexible material over-folded to form a substantially flat loop closely embracing the sides of said band, said tab being circumferentially slidably adjustable upon the forward are of said band and being closed transversely above and below said band with limited clearance between the interior ends of said loop and the edges of said band sufficient to allow sticking engagement of said tab with the edges of said band when canted, said tether including an elastic portion unitary with said tab having coupling means at its free end for a toy, said elastic tether portion tending to stretch in a longitudinal direction when stressed and tending to return to its original length when unstressed, said tether, including said tab, being free to swing radially at any point at which said tab may be adjustably positioned whereby the child, upon grasping tethered toy, may move it to the limit of his reach, thereby stretching the tether so that it snaps the toy back when the toy is let go, said tab being lockingly canted when the direction of pull by the child is such as to create a force component approximately tangential to the band at the position point of the tab.

A TENTH EXAMPLE, U.S. Pat. No. 3,501,774 to Norman teaches a garter for hosiery having a multitude of resiliently deformable hook elements which penetrate the material of the hose and engage the loops thereof for supporting the hose in position on the leg of a persons without the use of clasps or the like engaging the hose.

AN ELEVENTH EXAMPLE, U.S. Pat. No. 4,159,792 to Siegal teaches a tether or leash for gloves such as ski gloves, to maintain the glove attached to the wrist or wrist encircling garment, such as a parka sleeve, of the wearer when the glove is temporarily removed for some purpose; and generally including a length of elastic cord with eyeleted ends, one end passing through the eyelet at the opposite end to present a loop or band portion encircling the wrist area of the wearer and wherein the loop or band portion may be adjusted for approximate sizing by knotting the cord between the ends thereof.

A TWELFTH EXAMPLE, U.S. Pat. No. 4,489,867 to Schwemberger teaches a band worn on the users arm or wrist that has a short strap which carries a small item for occasional use such as a key. The strap has a captive end which is connected to the band, and a free end which retains the small item. The strap extends from the band in an access position, and is sufficiently long to permit the user to manipulate the small item using the thumb and forefingers on the same arm with the band. The band and the free end of the strap have selectively positioned loop-and-pile fasteners thereon for releasably securing the strap around the band in a concentric storage position. The small item retained at the free end of the strap is stored between the strap and the band in the concentric storage position. For use, the user pulls the strap away from the band with his opposite hand releasing the band and the small item from the storage position into the access position.

A THIRTEENTH EXAMPLE, U.S. Pat. No. 4,525,877 to Chong teaches an improved sports glove, for use in a game such as racquetball, having a front portion comprised of a strong, substantially inextensible material such as leather, and a rear portion made from a perspiration absorbing material, such as terry cloth. The glove also includes an integral wrist portion which is made of the same perspiration absorbing material as the rear portion, and attached to this wrist portion is a wrist support band which is wrapped around the wrist and secured by a piece of Velcro. Reinforcing pads may be placed on the front portion of the glove in positions particularly susceptible to wear. A very smooth elastic material may also be inserted between the front and rear portions of the fingers so as to provide the fingers with greater freedom of movement. This very smooth elastic material should be of a size smaller than the rear finger portions and larger than the front finger portions so as to impart a natural curvature to the glove fingers.

A FOURTEENTH EXAMPLE, U.S. Pat. No. 4,825,475 to Smart teaches a pantleg restraining band which is somewhat like a removable cuff for the lower end of the pantleg. The unit will ordinarily come in pairs, and comprises a band, which may be elastic, and which defines spaced, inverted pockets which receive plastic clips to clip onto the pantleg. The band has hook-and-loop fastener material so that it can be wrapped around the bottom of the pantleg and engaged on itself to peg the pants.

A FIFTEENTH EXAMPLE, U.S. Pat. No. 4,932,079 to Bridgewater teaches a garment supporter comprising a belt and an affixed harness the functional purpose of which is to maintain the position of an upper torso garment on the body of a wearer. The belt encircles the torso and the outer surface of the lower portion of such a garment, has at least one slip resistant surface engageable therewith, and thereby maintains its own position in relation to the garment. The harness is connected to the rear of the belt, extends through the crotch, is again connected to the front of the belt, and thereby maintains the position of the belt and the position of the garment relative to the body of the wearer.

A SIXTEENTH EXAMPLE, U.S. Pat. No. 5,204,996 to Ehmka teaches a tubular "L" shaped member that includes a tubular foot and leg cover interconnected by a single cavity, wherein the foot covering includes a planar bottom surface formed with spaced parallel ribs coextensive therewith. The upper terminal end of the leg cover portion includes a reinforcement strip to include a plurality of spaced bores directed therethrough, wherein each bore is arranged for securement to a clip member. Each clip member includes a plurality of clamps to grasp the leg cover portion and a clothing garment positioned thereabove.

A SEVENTEENTH EXAMPLE, U.S. Pat. No. 5,214,798 to McLaughlin teaches a baseball glove that is utilized in combination with an anchor strap to maintain the baseball glove about an individual's wrist. The strap structure is formed of an L-shaped configuration having cooperating hook and loop fasteners to have a first strap directed about an individual's wrist, with a second strap secured to the associated baseball glove. A modification of the invention includes a rosin bag arrangement, as well as wrist stiffener accommodated by the anchor strap structure.

AN EIGHTEENTH EXAMPLE, U.S. Pat. No. 5,214,805 to Cochran teaches an apparatus for blousing a pant leg. The central hole of a tubular, torus shaped, horizontally positioned, elastic sleeve is of a size to accept a calf of a person's leg. The sleeve includes a pair of opposing slits that each provide entry into the interior of the sleeve from above. A pair of foundation forms each have a curved, horizontally extending first portion positioned within the sleeve for providing conformal alignment of the sleeve with the natural curvature of a human calf. Each form further includes a second portion contiguous with the first portion and extending vertically from the first portion for protruding through one of the slits of the sleeve. A strap attachment slit if further included on each second portion for engaging at least one elastic anchoring strap, the strap holding the sleeve in place on the calf at a position adjacent to, and above, the top of a boot. As such, the sleeve encircles the calf, and the pant leg is bloused around the outside of the sleeve and folded under and upward between the sleeve and the calf, whereby the pant leg is elastically held between the sleeve and the calf.

A NINETEENTH EXAMPLE, U.S. Pat. No. 5,483,704 to Filipiak teaches a clip-on garter for retaining a sock fully upright while being worn within a boot whereby preventing sliding of the sock into the boot cavity caused by movement of a user's foot relative the boot. The clip-on garter comprises a boot clip member clampedly attachable to the boot at the top edge of the leg opening. The boot clip member is formed of an elongated strip of resilient plastic or metal folded back against itself to form an inverted U-shaped structure having generally parallel inside and outside tension arms. The two arm ends define a clamping zone therebetween wherebetween the edge of the boot opening may be retained. A strip of pile fabric material is disposed on the inside arm such that the sock fabric engages with the pile fabric material whereby the top edge of the sock is retained adjacent the top edge of the boot leg opening for preventing the sock from sliding down into the boot cavity.

A TWENTIETH EXAMPLE, U.S. Pat. No. 5,558,440 to Miller teaches an expandable pouch that can be easily compacted to form a relatively thin flat relatively non-obtrusive strip when empty. The compacted pouch will remain compact without falling open even with relatively vigorous activity and movement. The pouch may be provided with a strap for attaching the pouch to a user's wrist or waist.

A TWENTY-FIRST EXAMPLE, U.S. Pat. No. 5,704,066 to Yamamoto teaches a protective device comprising a glove constructed of an electrically conductive material to be worn on a hand of a person. A structure is for grounding the glove. Spark plug wires in an engine of a motor vehicle can be handled by the person without danger of electrical shock. This will also minimize damage to an ignition module and/or distributor components by grounding high voltage from a coil in the engine of the motor vehicle.

A TWENTY-SECOND EXAMPLE, U.S. Pat. No. 5,809,569 to Bruno et al. teaches a device (and method) for securing a glove (or mitten) haying two opposing ends and fastener for releasably fastening the opposing ends together to define the first strap as a continuous loop having a circumference extending over the glove around the wrist of the hand. A second strap is provided having a fixed end connected to the first strap and a free end which extends substantially perpendicular from a first part of the continuous loop of the first strap over the glove between two adjacent digits of the hand. The free end of the second strap has a fastener for releasably fastening the second strap to a second part of the continuous loop substantially circumferentially opposite the first part of the continuous loop. In the case where the glove defines a mitten, the above two adjacent digits are the thumb and index finger of the hand. The free end of the second strap of the device may further have a tapered width along a portion of the free end which extends between the two adjacent digits. This portion of the free end is substituted with a plurality of strips, such that each of the plurality of strips extends over the glove between a different set of two adjacent digits of the hand.

A TWENTY-THIRD EXAMPLE, U.S. Pat. No. 5,950,240 to Carpenter et al. teaches to retain a glove or mitten to a jacket, an elastic loop is sewn into the cuff of the sleeve which is sized to securely receive the barrel shaped cord lock at the end of a glove leash. The narrow glove loop opening prevents the larger cord lock from slipping through the loop, securely retaining the unworn glove to the jacket.

It is apparent that numerous innovations for garment anchoring devices have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide an anklet for encircling an ankle of a child and engaging a foot covering worn by the child so as to prevent loss of the foot covering if unintentionally removed that avoids the disadvantages of the prior art.

ANOTHER OBJECT of the present invention is to provide an ankle of a child and engaging a foot covering worn by the child so as to prevent loss of the foot covering if unintentionally removed that is simple and inexpensive to manufacture.

STILL ANOTHER OBJECT of the present invention is to provide an ankle of a child and engaging a foot covering worn by the child so as to prevent loss of the foot covering if unintentionally removed that is simple to use.

BRIEFLY STATED, STILL YET ANOTHER OBJECT of the present invention is to provide an anklet that includes a strap that encircles an ankle of a child, a quick disconnect buckle that is affixed to, and selectively maintains, the strap around the ankle, and a leash that depends from the strap and engages a foot covering worn by the child so as to prevent loss of the foot covering if unintentionally removed. The strap includes an ankle-facing layer that is made of an elastomer with a modulus of elasticity, and an ambient-facing layer that directly overlies the ankle-facing layer and is made of a fabric that has a limited modulus of elasticity so as to prevent the ankle-facing layer from passing the modulus of elasticity thereof and failing. The leash is an endless loop that extends through the foot covering and then extends back through itself, and in so doing, becomes self-fastened to the foot covering.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows:

FIG. 1 is a diagrammatic perspective view of the present invention in use;

FIG. 2 is an enlarged diagrammatic side elevational view of the area generally enclosed by the dotted curve identified by arrow 2 in FIG. 1;

FIG. 3 is an enlarged diagrammatic side elevational view of the area generally enclosed by the dotted curve identified by arrow 3 FIG. 2;

FIG. 4 is an enlarged diagrammatic perspective view of the area generally enclosed by the dotted curve identified by arrow 4 in FIG. 2 of the present invention; and FIG. 5 is an enlarged diagrammatic cross sectional view taken on line 5—5 in FIG. 42

LIST OF REFERENCE NUMERALS UTILIZED IN THE DRAWING

10 anklet of present invention 10 for encircling ankle 12 of child 14 and engaging foot covering 16 worn by child 14 so as to prevent loss of foot covering 16 if unintentionally removed
12 ankle of child 14
14 child
16 foot covering worn by child 14
18 strap for encircling ankle 12 of child 14
20 leash for engaging foot covering 16 worn by child 14 so as to prevent loss of foot covering 16 if unintentionally removed
22 ankle-facing layer of material of strap 18
24 ambient-facing layer of material of strap 18
26 first end of strap 18
28 second end of strap 18
30 quick disconnect buckle
32 female portion of quick disconnect buckle 30
34 male portion of quick disconnect buckle 30
36 cushion formed by first end 26 of strap 18 for preventing quick disconnect buckle 30 from producing adverse effect on ankle 12 of child 14
38 endless loop of leash 20 for extending through foot covering 12 and then extending back through itself, and in so doing, being self-fastened to foot covering 12

DETAILED DESCRIPTION OF THE PREFERRED EMBODIMENT

Referring now to the figures, in which like numerals indicate like parts, and particularly to FIGS. 1–3, the anklet of the present invention is shown generally at 10 for encircling an ankle 12 of a child 14 and engaging a foot covering 16 worn by the child 14 so as to prevent loss of the foot covering 16 if unintentionally removed.

The configuration of the anklet 10 can best be seen in FIGS. 4 and 5, and as such, will be discussed with reference thereto.

The anklet 10 comprises a strap 18 that has a length and is for encircling the ankle 12 of the child 14, and a leash 20 that depends from the strap 18 and is for engaging the foot covering 16 worn by the child 14 so as to prevent loss of the foot covering 16 if unintentionally removed.

The strap 18 is slender and elongated.

The strap 18 comprises an ankle-facing layer of material 22.

The strap 18 further comprises an ambient-facing layer of material 24 that directly overlies the ankle-facing layer of material 22 thereof.

The ankle-facing layer of material 22 of the strap 18 is made of an elastomer that has a modulus of elasticity and is for allowing the strap 18 to fit different sized ankles 12 comfortably.

The ambient-facing layer of material 24 of the strap 18 is made of a fabric having a limited modulus of elasticity that prevents the ankle-facing layer of material 22 of the strap 18 from passing the modulus of elasticity thereof and failing.

The fabric of the ambient-facing layer of material 24 of the strap 18 is nylon.

The strap 18 has a first free end 26 and a second free end 28.

The anklet 10 further comprises a quick disconnect buckle 30 that has a female portion 32 and a male portion 34 that selectively engages the female portion 32 of the quick disconnect buckle 30.

The female portion 32 of the quick disconnect buckle 30 is affixed to, and overlies, the first end 26 of the strap 18.

The female portion 32 of the quick disconnect buckle 30 is sewn to, and overlies, the first end 26 of the strap 18.

The first end 26 of the strap 18 extends past the female portion 32 of the quick disconnect buckle 30 on all edges thereof so as to provide a cushion 36 for preventing the quick disconnect buckle 30 from producing an adverse effect on the ankle 12 of the child 14.

The second end 28 of the strap length adjustably engages the male portion 34 of the quick disconnect buckle 30 so as to adjust the length of the strap 18.

The leash 20 is attached to the strap 18, in close proximity to the female portion 32 of the quick disconnect buckle 30 for allowing the quick disconnect buckle 30 to be fastened after the leash 20 has been engaged with the foot covering 12 without having to turn the strap 18.

The leash 20 is sewn to the strap 18 under, and with, the female portion 32 of the quick disconnect buckle 30 so as to be engaged between the first end 26 of the strap 18 and the female portion 32 of the quick disconnect buckle 30.

The leash 20 is an endless loop 38 for extending through the foot covering 12 and then extending back through itself, and in so doing, becomes self-fastened to the foot covering 12.

The endless loop 38 of the leash 20 is made of an elastomer string.

It will be understood that each of the elements described above, or two or more together, may also find a useful application in other types of constructions differing from the types described above.

While the invention has been illustrated and described as embodied in an anklet for encircling an ankle of a child and engaging a foot covering worn by the child so as to prevent loss of the foot covering if unintentionally removed, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. An anklet for encircling an ankle of a child and engaging a foot covering worn by the child so as to prevent loss of the foot covering if unintentionally removed, said anklet comprising:

a) a strap for encircling the ankle of the child; and b) a leash depending from said strap;

wherein said strap has a length; and said leash is for engaging the foot covering worn by the child so as to prevent loss of the foot covering if unintentionally removed, wherein said strap has a first free end; and wherein said strap has a second free end; further comprising a quick disconnect buckle, wherein said quick disconnect buckle has a female portion;

wherein said quick disconnect buckle has a male portion; and wherein said male portion of said quick disconnect buckle selectively engages said female portion of said quick disconnect buckle, wherein said leash is sewn to said strap under said female portion of said quick disconnect buckle so as to be engaged between said first end of said strap and said female portion of said quick disconnect buckle.

2. The anklet as defined in claim 1, wherein said strap is slender and elongated.

3. The anklet as defined in claim 1 wherein said strap comprises an ankle-facing layer of material.

4. The anklet as defined in claim 3, wherein said strap comprises an ambient-facing layer of material; and wherein said ambient-facing layer of material directly overlies said ankle-facing layer of material.

5. The anklet as defined in claim 4, wherein said ankle-facing layer of material of said strap is made of an elastomer;

wherein said elastomer of said ankle-facing layer of material has a modulus of elasticity; and wherein said elastomer of said ankle-facing layer of material is for allowing said strap to fit different sized ankles comfortably.

6. The anklet as defined in claim 4, wherein said ambient-facing layer of material of said strap is made of a fabric.

7. The anklet as defined in claim 6, wherein said fabric of said ambient-facing layer of material has a limited modulus of elasticity; and wherein said limited modulus of elasticity of said fabric of said ambient-facing layer of material prevents said ankle-facing layer of material of said strap from passing said modulus of elasticity thereof and failing.

8. The anklet as defined in claim 6, wherein said fabric of said ambient-facing layer of material of said strap is nylon.

9. The anklet as defined in claim 1, wherein said leash is an endless loop; and wherein said endless loop of said leash is for extending through the foot covering and then extending back through itself, and in so doing, becomes self-fastened to the foot covering.

10. The anklet as defined in claim 9 wherein said endless loop of said leash is made of an elastomer string.

11. An anklet for encircling an ankle of a child and engaging a foot covering worn by the child so as to prevent loss of the foot covering if unintentionally removed, said anklet comprising:

a) a strap for encircling the ankle of the child; and b) a leash depending from said strap;

wherein said strap has a length; and wherein said leash is for engaging the foot covering worn by the child so as to prevent loss of the foot covering if unintentionally removed, wherein said strap has a first free end; and wherein said strap has a second free end; further comprising a quick disconnect buckle, wherein said quick disconnect buckle has a female portion;

wherein said quick disconnect buckle has a male portion; and wherein said male portion of said quick disconnect buckle selectively engages said female portion of said quick disconnect buckle, wherein said leash is sewn to said strap with said female portion of said quick disconnect buckle.

12. The anklet as defined in claim 11 wherein said strap is slender and elongated.

13. The anklet as defined in claim 11, wherein said strap comprises an ankle-facing layer of material.

14. The anklet as defined in claim 13, wherein said strap comprises an ambient-facing layer of material; and wherein said ambient-facing layer of material directly overlies said ankle-facing layer of material.

15. The anklet as defined in claim 14, wherein said ankle-facing layer of material of said strap is made of an elastomer;

wherein said elastomer of said ankle-facing layer of material has a modulus of elasticity; and wherein said elastomer of said ankle-facing layer of material is for allowing said strap to fit different sized ankles comfortably.

16. The anklet as defined in claim 14, wherein said ambient-facing layer of material of said strap is made of a fabric.

17. The anklet as defined in claim 16, wherein said fabric of said ambient-facing layer of material has a limited modulus of elasticity; and wherein said limited modulus of elasticity of said fabric of said ambient-facing layer of material prevents said ankle-facing layer of material of said strap from passing said modulus of elasticity thereof and failing.

18. The anklet as defined in claim 16, wherein said fabric of said ambient-facing layer of material of said strap is nylon.

19. The anklet as defined in claim 11, wherein said leash is an endless loop; and wherein said endless loop of said leash is for extending through the foot covering.

20. The anklet as defined in claim 19, wherein said endless loop of said leash is made of an elastomer string.

* * * * *